US012480378B2

(12) United States Patent
Vasques et al.

(10) Patent No.: US 12,480,378 B2
(45) Date of Patent: Nov. 25, 2025

(54) ANNULAR BARRIER WITH VALVE UNIT

(71) Applicant: Welltec Manufacturing Center Completions ApS, Esbjerg N (DK)

(72) Inventors: Ricardo Reves Vasques, Zug (CH); Bala Prasad, Zug (CH)

(73) Assignee: Welltec Manufacturing Center Completions ApS, Esbjerg N (CH)

( * ) Notice: Subject to any disclaimer, the term of this patent is extended or adjusted under 35 U.S.C. 154(b) by 0 days.

(21) Appl. No.: 18/486,791

(22) Filed: Oct. 13, 2023

(65) Prior Publication Data

US 2024/0125210 A1 Apr. 18, 2024

(30) Foreign Application Priority Data

Oct. 13, 2022 (EP) ..... 22201473

(51) Int. Cl.
*E21B 33/127* (2006.01)
*E21B 34/10* (2006.01)

(52) U.S. Cl.
CPC ..... *E21B 33/1272* (2013.01); *E21B 34/103* (2013.01)

(58) Field of Classification Search
CPC .. E21B 23/06; E21B 33/1208; E21B 33/1243; E21B 33/127; E21B 33/1272; E21B 33/1285
See application file for complete search history.

(56) References Cited

U.S. PATENT DOCUMENTS 10,519,741 B2 * 12/2019 Vasques ..... E21B 33/127
10,605,039 B2 * 3/2020 Vasques ..... E21B 23/0412
(Continued)

FOREIGN PATENT DOCUMENTS

EP 3199747 A1 8/2017
EP 3663510 A1 6/2020
(Continued)

OTHER PUBLICATIONS

Extended Search Report for EP22201473.0 mailed Feb. 20, 2023, 10 pages.

*Primary Examiner* — Jennifer H Gay
(74) *Attorney, Agent, or Firm* — Nixon & Vanderhye P.C.

(57) ABSTRACT

The present invention relates to an annular barrier for providing zonal isolation in an annulus downhole between a well tubular metal structure and another well tubular metal structure or a wall of a borehole, comprising a tubular metal part configured to be mounted as part of the well tubular metal structure and having an inside and an axial extension along the well tubular metal structure, an expandable metal sleeve surrounding the tubular metal part, each end of the expandable metal sleeve being connected with the tubular metal part, defining an expandable space between the expandable metal sleeve and the tubular metal part, and an expansion opening in the tubular metal part through which fluid enters in order to expand the expandable metal sleeve, wherein the annular barrier further comprises a valve unit having a first position and a second position; in the second position for leading pressurised fluid from the expansion opening to the expandable space for expanding the expandable metal sleeve, the valve unit comprises a first aperture in fluid communication with the expansion opening, a second aperture in fluid communication with the annulus and a third aperture in fluid communication with the expandable space. The invention also relates to a downhole system comprising the annular barrier and the well tubular metal structure.

10 Claims, 8 Drawing Sheets

(56) References Cited

U.S. PATENT DOCUMENTS

Figure 1:
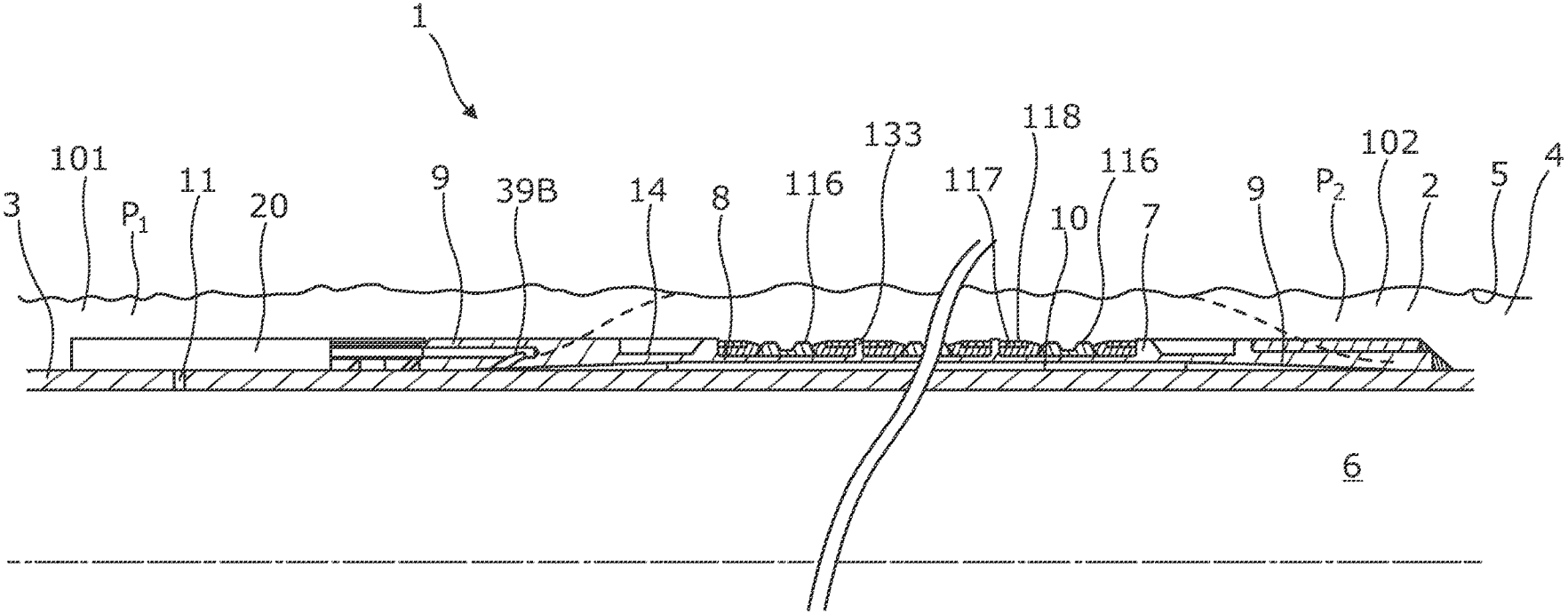

| | | | | |
|---|---|---|---|---|
| 10,927,636 | B2 * | 2/2021 | Prasad | E21B 23/04 |
| 10,947,810 | B2 * | 3/2021 | Vasques | E21B 33/122 |
| 11,002,107 | B2 * | 5/2021 | Kumar | E21B 34/10 |
| 11,142,987 | B2 * | 10/2021 | Vasques | E21B 33/1277 |
| 2017/0211347 | A1 * | 7/2017 | Vasques | E21B 21/08 |
| 2018/0148992 | A1 * | 5/2018 | Vasques | E21B 23/0412 |
| 2019/0383114 | A1 * | 12/2019 | Vasques | E21B 33/1277 |
| 2020/0040693 | A1 * | 2/2020 | Vasques | E21B 33/122 |
| 2020/0173245 | A1 * | 6/2020 | Prasad | E21B 23/06 |
| 2020/0248530 | A1 * | 8/2020 | Kumar | E21B 34/10 |
| 2021/0071495 | A1 * | 3/2021 | Vasques | E21B 33/1277 |
| 2024/0125210 | A1 * | 4/2024 | Vasques | E21B 34/103 |

FOREIGN PATENT DOCUMENTS

| | | | |
|---|---|---|---|
| EP | 3690183 | A1 | 8/2020 |
| EP | 3792450 | A1 | 3/2021 |

* cited by examiner

ANNULAR BARRIER WITH VALVE UNIT

This application claims priority to EP patent application Ser. No. 22/201,473.0 filed Oct. 13, 2022, the entire contents of which is hereby incorporated by reference.

The present invention relates to an annular barrier for providing zonal isolation in an annulus downhole between a well tubular metal structure and another well tubular metal structure or a wall of a borehole. The invention also relates to a downhole system comprising the annular barrier and the well tubular metal structure.

Wells are often completed by displacing cement down the casing by means of a dart which is moved down the casing by pressurised fluid. Once the dart reaches the cement shoe in the toe of the casing, the dart is seated in the cement shoe. Subsequently, the pressurised fluid may be used for other purposes. When setting barriers or similar components, the pressure is increased and decreased in a predetermined pattern in order to activate certain parts during the completion of the well. However, if the pressure is decreased before the cement has set, there is a risk that the cement will be sucked back into the casing, which is not desirable.

Prior art examples of annular barriers are described in EP3663510, EP3792450, EP3690183 and EP3199747.

It is an object of the present invention to wholly or partly overcome the above disadvantages and drawbacks of the prior art. More specifically, it is an object to provide an improved annular barrier eliminating the risk of cement being sucked into the casing.

The above objects, together with numerous other objects, advantages and features, which will become evident from the below description, are accomplished by a solution in accordance with the present invention by an annular barrier for providing zonal isolation in an annulus downhole between a well tubular metal structure and another well tubular metal structure or a wall of a borehole, comprising:

a tubular metal part configured to be mounted as part of the well tubular metal structure and having an inside and an axial extension along the well tubular metal structure, an expandable metal sleeve surrounding the tubular metal part, each end of the expandable metal sleeve being connected with the tubular metal part, defining an expandable space between the expandable metal sleeve and the tubular metal part, and an expansion opening in the tubular metal part through which fluid enters in order to expand the expandable metal sleeve, wherein the annular barrier further comprises a valve unit having a first position and a second position; and in the second position for leading pressurised fluid from the expansion opening to the expandable space for expanding the expandable metal sleeve, the valve unit comprises a first aperture in fluid communication with the expansion opening, a second aperture in fluid communication with the annulus and a third aperture in fluid communication with the expandable space, the valve unit further comprising:

a unit bore having a bore extension and comprising a first bore part and a second bore part, the first aperture being arranged in the first bore part, and the second aperture and the third aperture being arranged in the second bore part and displaced along the bore extension, a unit piston arranged in the unit bore, the unit piston comprising a first piston part which is arranged in the second bore part in the first position and has an outer diameter substantially corresponding to an inner diameter of the second bore part, and the unit piston further comprising a second piston part which is arranged in the first bore part in the first position and has an outer diameter substantially corresponding to an inner diameter of the first bore part, and a shear element preventing movement of the unit piston from the first position to the second position until a predetermined force is reached, and the unit piston is allowed to move, wherein the second aperture is in fluid communication with the third aperture in the first position so that pressure equalisation between the annular space and the annulus occurs while running the annular barrier into the well, and wherein the valve unit further comprises a piston sleeve arranged in the unit bore, said unit bore having an edge extending radially inwards in relation to the bore extension, the piston sleeve at least partly circumferenting the second piston part, and the shear element engages both the unit piston and the piston sleeve so that the unit piston and the piston sleeve are fastened together until the piston sleeve is prevented by the edge from moving, and the shear element is sheared.

By having the piston sleeve arranged to at least partly surround the second piston part, and once the shearing has occurred, a small release of pressure will move the unit piston to the second position as the pressure no longer acts on the piston sleeve, and the cement therefore cannot be sucked into the well tubular metal structure as the pressure is not released completely in order to move the valve from a "run-in" position to an "expansion" position. Thus, the annular barrier can be set without releasing the pressure completely, but merely a small decrease in pressure will move the valve unit from the first position to the second position, i.e. the expansion position.

Also, the annular barrier may further comprise a locking mechanism configured to lock the unit piston in the second position.

Furthermore, the first and second piston parts may comprise sealing means arranged in circumferential grooves on an outer face of the piston parts.

In addition, the fourth aperture may be in fluid communication with the annulus or a shuttle valve.

Moreover, the outer diameter of the second piston part may be larger than the outer diameter of the first piston part.

Also, the outer diameter of the first piston part may be a first outer diameter, and the outer diameter of the second piston part may be a second outer diameter, the first outer diameter being equal, larger or smaller than the second outer diameter.

Further, the piston sleeve may have a first sleeve part and a second sleeve part, the first sleeve part and the second sleeve part being two separate parts, and the shear element engages only the second sleeve part, the first sleeve part abuts the second sleeve part, and the first sleeve part is arranged closer to the first piston part than the second sleeve part along the bore extension.

Also, the second sleeve part may be formed of several collets which are held together around the second piston part by fastening elements.

Furthermore, the several collets may form the locking mechanism.

In addition, the piston sleeve may comprise sealing means arranged in circumferential grooves in an outer face of the piston sleeve.

Moreover, an inner diameter of the piston sleeve may correspond to the outer diameter of the second piston part.

Further, at least a first part of the first bore part may have a larger inner diameter than the second bore part.

In addition, the first part of the first bore part may be arranged further away from the first piston part than the first aperture.

Moreover, the first part of the first bore part may have an inner diameter corresponding to the outer diameter of the piston sleeve.

Further, the piston sleeve may have a first inner diameter corresponding to the outer diameter of a first part of the second piston part and a second inner diameter corresponding to the outer diameter of a second part of the second piston part, which is smaller than the first part of the second piston part.

Also, the unit bore may comprise a spring element arranged between the second piston part and a first end of the unit bore, the unit bore comprising a second end arranged at the second bore part.

Furthermore, the unit piston may have an intermediate part arranged between the first and second piston parts, the intermediate part having a smaller outer diameter than that of the first and second piston parts.

In addition, the unit piston may comprise a third piston part arranged in a third bore part, and the spring element may be arranged to abut the third piston part and the first end of the unit bore.

Also, the unit bore may have the edge and a third bore part, the first bore part may be arranged between the second bore part and the third bore part, the first bore part may have a first inner diameter, the third bore part may have a third inner diameter, and the third inner diameter may be smaller than the first inner diameter forming the edge.

Moreover, the unit bore may have the edge extending between an outer inner diameter of the first part of the first bore part and radially inwards in relation to the bore extension.

Further, the edge of the unit bore may be formed by an end of a sleeve element in the first bore part.

In addition, the annular barrier may further comprise a shear pin assembly configured to permanently isolate the annular barrier from the well tubular metal structure after expansion, said shear pin assembly having a first opening in fluid communication with the second aperture of the valve unit, a second opening in fluid communication with the annular space of the annular barrier and a third opening in fluid communication with the annulus, the shear pin assembly having a first position in which expansion fluid from the second aperture of the valve unit is allowed to flow into the annular space and a second position in which fluid connection to the second aperture is blocked, which prevents expansion fluid from entering the space.

Further, the edge may be provided by an end of a bore sleeve element in the first bore part.

Also, the sleeve element may have an outer diameter corresponding to the inner diameter of the first part of the first bore part and may have an inner diameter corresponding to an outer diameter of a second part of the first piston part.

Furthermore, the first part of the second piston part may comprise sealing means and may be circumferented by the piston sleeve.

In addition, the first part of the second piston part may be arranged closer to the first piston part than the second part of the first piston part.

Moreover, the outer diameter of the first part of the second piston part may be larger than the outer diameter of the second part of the second piston part.

Further, the unit piston may comprise a fluid channel being a through-bore providing fluid communication between the first bore part and the second part of the second bore part.

Also, the piston sleeve may have a first end surface.

Furthermore, the first piston part may have a first piston face facing the first aperture.

In addition, the second piston part may have a second piston face facing the first aperture.

Moreover, the first end face and the second piston face may have a common face area being larger than the first piston face.

Further, the annular barrier may also comprise a shear pin assembly configured to permanently isolate the annular barrier from the well tubular metal structure after expansion, said shear pin assembly having a first opening in fluid communication with the second aperture of the valve unit, a second opening in fluid communication with the annular space of the annular barrier and a third opening in fluid communication with the annulus, the shear pin assembly having a first position in which expansion fluid from the second aperture of the valve unit is allowed to flow into the annular space and a second position in which fluid connection to the second aperture is blocked, which prevents expansion fluid from entering the space.

Also, the shear pin assembly may have a bore having a bore extension and comprising a first bore part having a first inner diameter and a second bore part having an inner diameter which is larger than that of the first bore part, wherein the first opening and the second opening are arranged in the first bore part and displaced along the bore extension, and the shear pin assembly may further comprise:

an assembly piston arranged in the bore, the assembly piston comprising a first piston part having an outer diameter substantially corresponding to the inner diameter of the first bore part and comprising a second piston part having an outer diameter substantially corresponding to the inner diameter of the second bore part, and a rupture element preventing movement of the assembly piston until a predetermined pressure in the bore is reached.

Furthermore, the shear pin assembly may also comprise a locking element adapted to mechanically lock the assembly piston when the assembly piston is in the closed position, blocking the first opening.

In addition, the assembly piston may have an initial position in which the first opening is in fluid communication with the second opening and a closed position in which the second opening is in fluid communication with the third opening in order to equalise the pressure between the annular space and the annulus.

Moreover, the downhole annular barrier may further comprise an anti-collapsing unit comprising an element movable between a first unit position and a second unit position, the anti-collapsing unit having a first inlet which is in fluid communication with the first zone and a second inlet which is in fluid communication with the second zone, and the anti-collapsing unit having an outlet which is in fluid communication with the annular space through the shear pin assembly when the assembly piston is in the closed position, blocking the first opening.

Further, the first inlet may be in fluid communication with the outlet for equalising the first pressure of the first zone with the pressure of the annular space in the first unit position, and in the second unit position the second inlet may be in fluid communication with the outlet for equalising the second pressure of the second zone with the space pressure.

Also, the valve system may comprise both valve units, and the valve system may also comprise an anti-collapsing unit.

Finally, the invention comprises a downhole system comprising the annular barrier and the well tubular metal structure.

Figure 2:
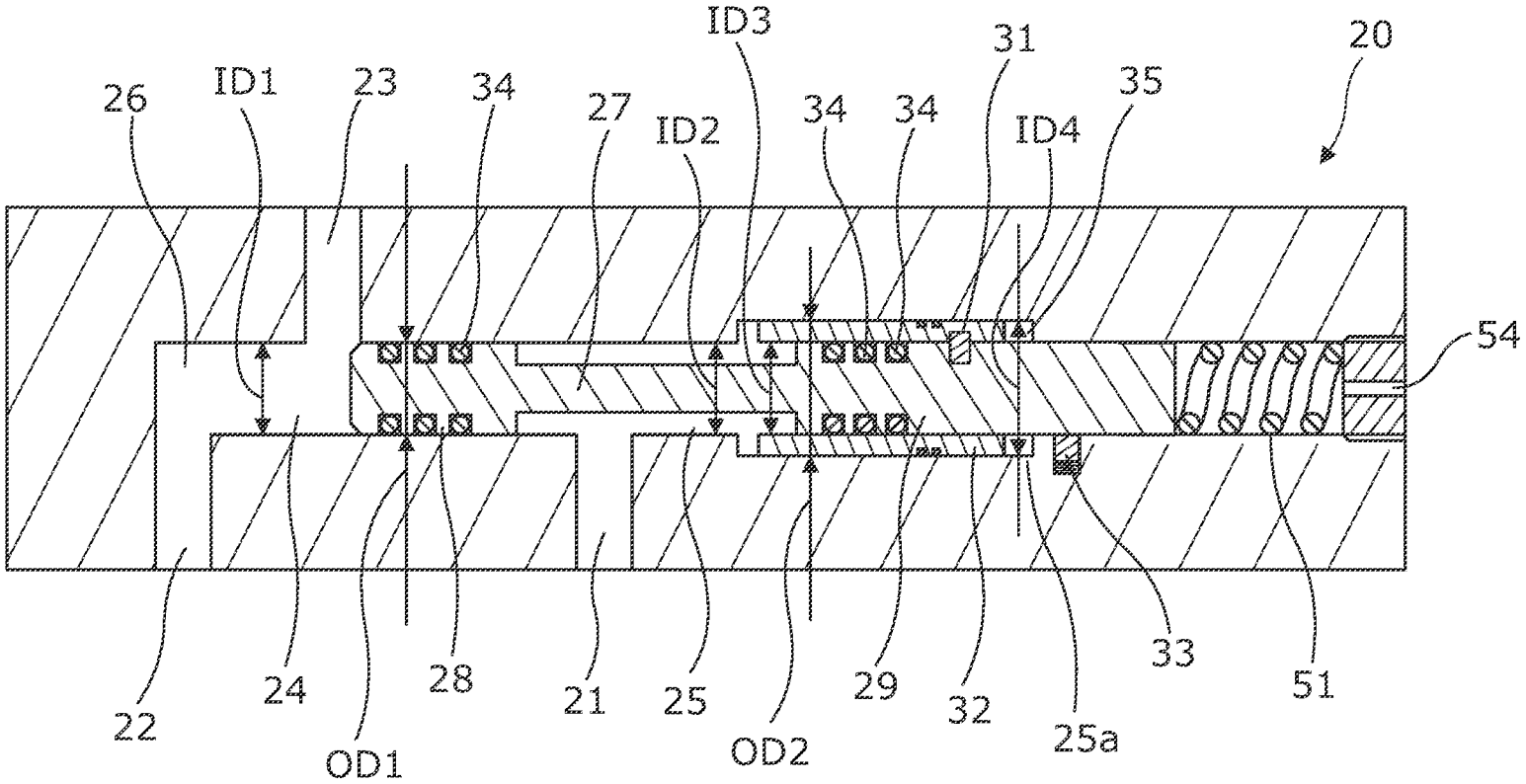
Figure 3:
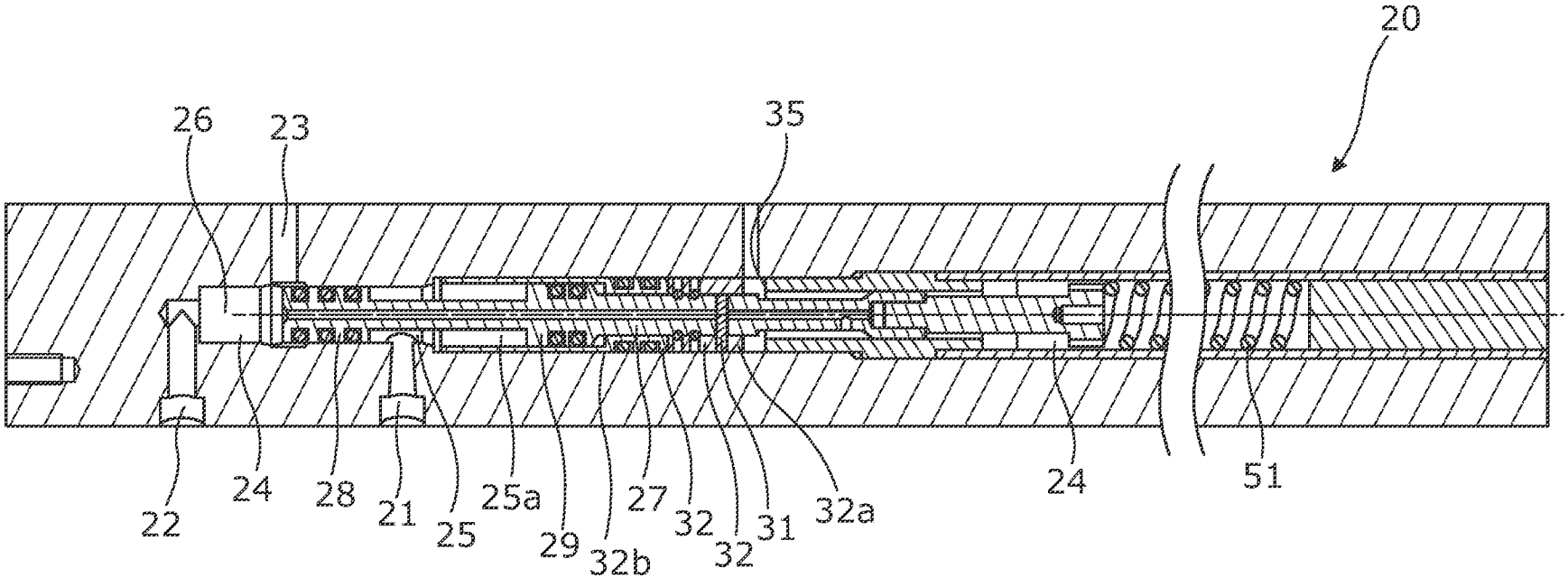
Figure 4:
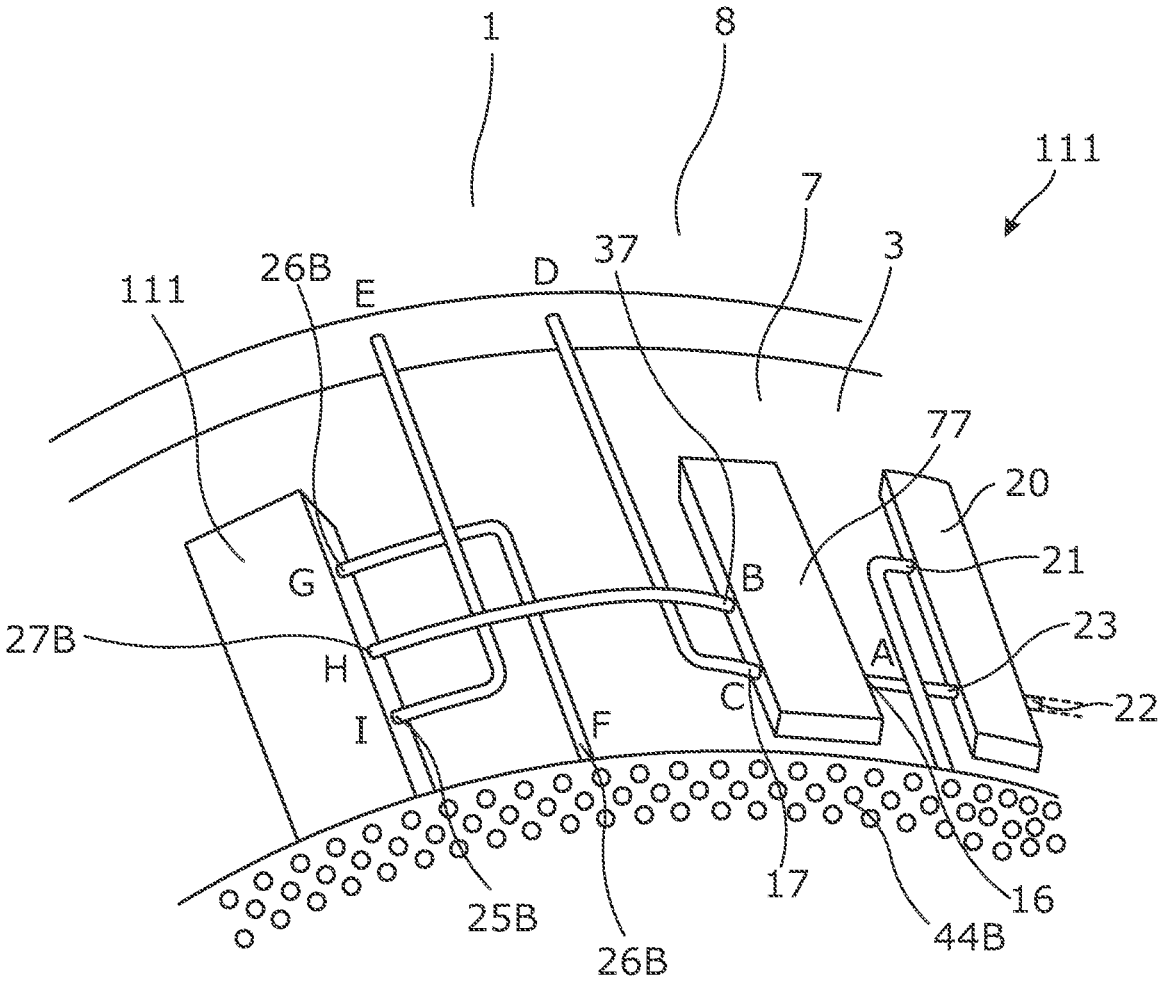
Figure 5:
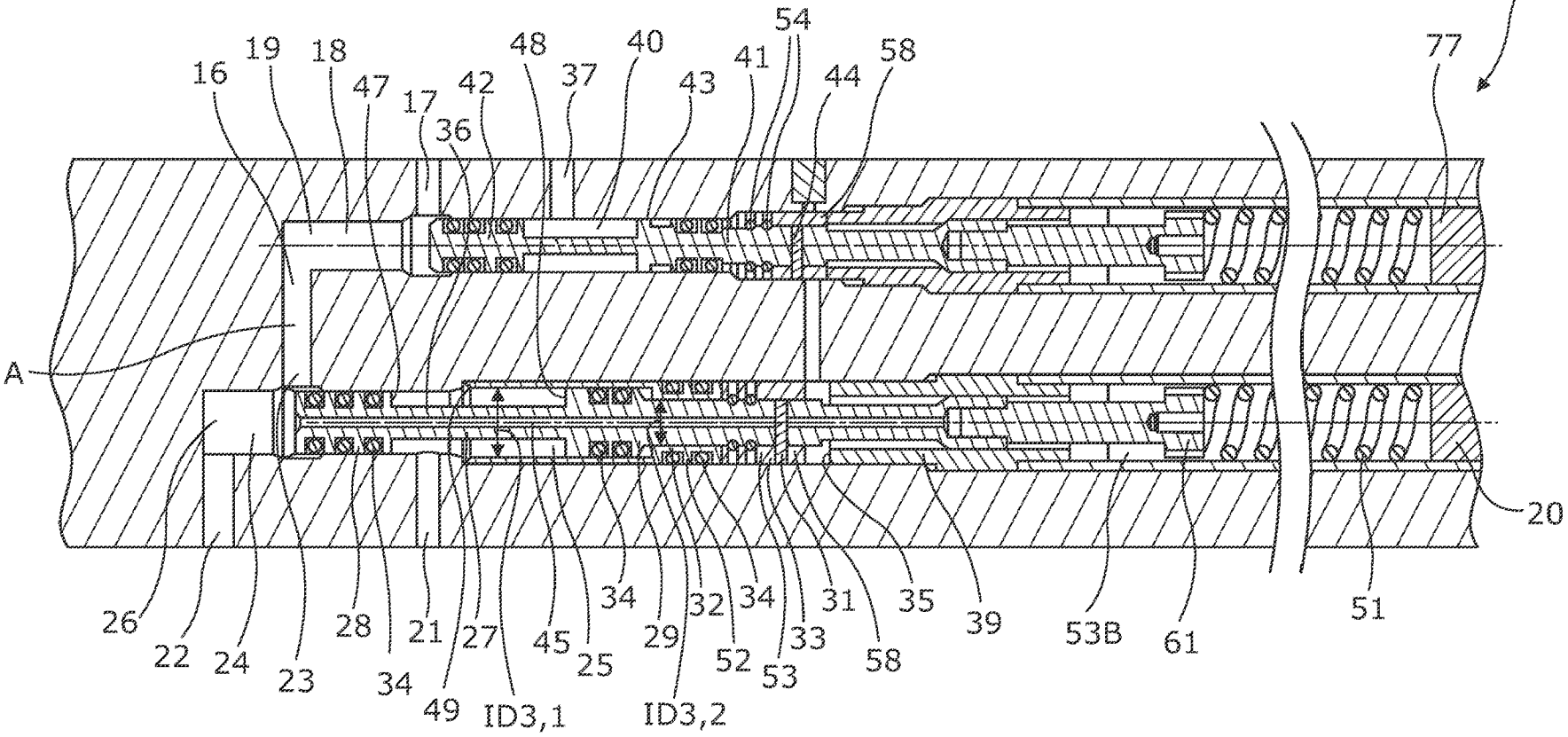
Figure 6:
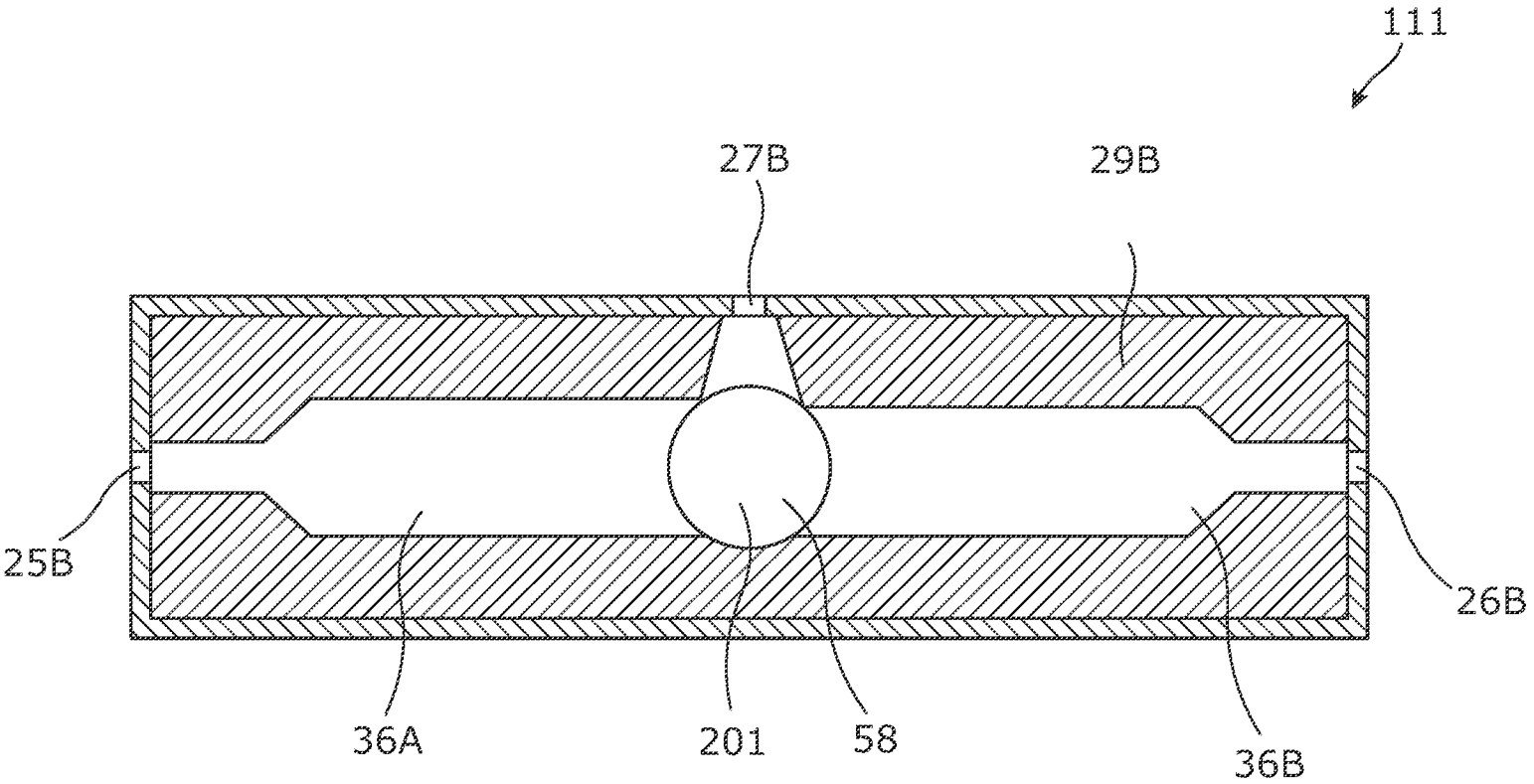
Figure 7:
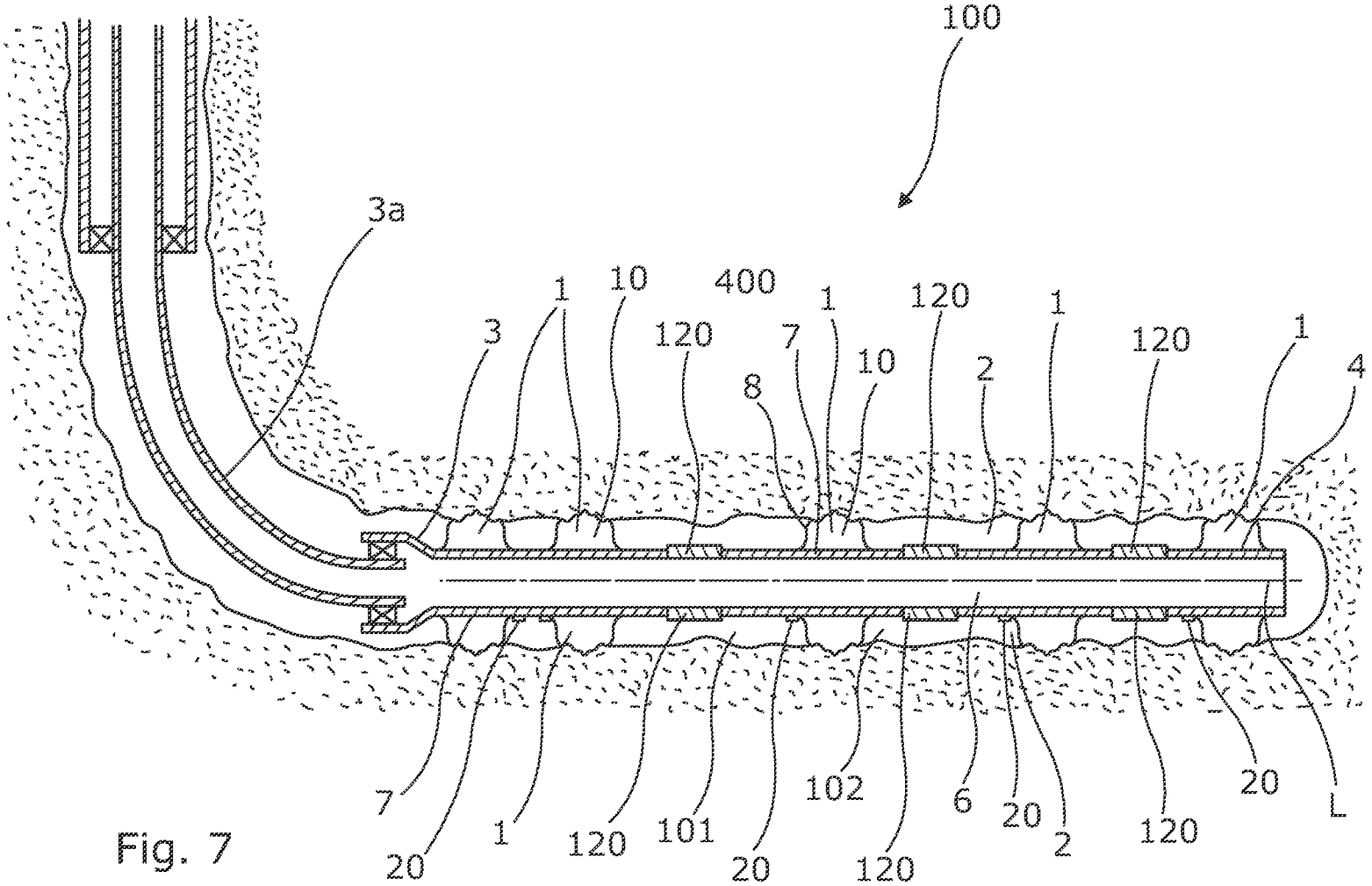
Figure 8:
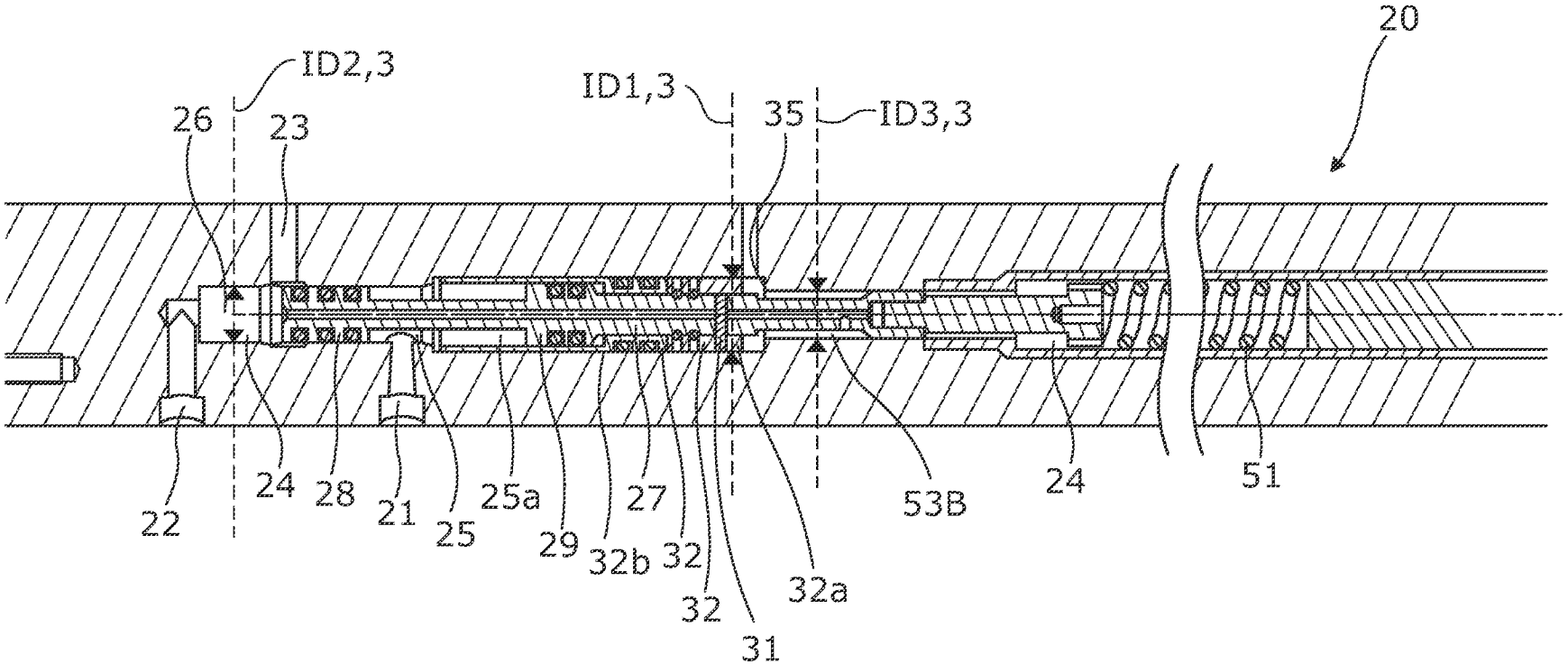

The invention and its many advantages will be described in more detail below with reference to the accompanying schematic drawings, which for the purpose of illustration show some non-limiting embodiments and in which:

FIG. 1 shows a cross-sectional view of an annular barrier mounted as part of a well tubular metal structure and having a valve unit, FIG. 2 shows a cross-sectional view of a valve unit in its first position, FIG. 3 shows a cross-sectional view of another valve unit in its first position, FIG. 4 shows a perspective of part of an annular barrier having a valve unit, a shear pin assembly and an anti-collapsing unit, FIG. 5 shows a cross-sectional view of another valve unit in its first position and a shear pin assembly, FIG. 6 shows a cross-sectional view of an anti-collapsing unit, FIG. 7 shows a cross-sectional view of a downhole system having several annular barriers, and FIG. 8 shows a cross-sectional view of another valve unit in its first position.

All the figures are highly schematic and not necessarily to scale, and they show only those parts which are necessary in order to elucidate the invention, other parts being omitted or merely suggested.

FIG. 1 shows an annular barrier 1 for providing zonal isolation in an annulus 2 downhole between a well tubular metal structure 3 and another well tubular metal structure or a wall 5 of a borehole 4. The annular barrier 1 comprises a tubular metal part 7 mounted as part of the well tubular metal structure 3 and having an inside 6 and an axial extension L along the well tubular metal structure. The annular barrier 1 further comprises an expandable metal sleeve 8 surrounding the tubular metal part 7, and each end 9 of the expandable metal sleeve 8 is connected with the tubular metal part 7, defining an expandable space 10 between the expandable metal sleeve 8 and the tubular metal part 7. The tubular metal part 7 has an expansion opening 11 through which fluid from within the tubular metal part 7 enters in order to expand the expandable metal sleeve 8. The tubular metal part 7 comprises a fluid channel 39B for this fluid communication. The annular barrier 1 further comprises a valve unit 20 having a first position and a second position. In the second position, pressurised fluid is led from the expansion opening 11 to the expandable space 10 for expanding the expandable metal sleeve 8.

As shown in FIG. 2, the valve unit 20 comprises a first aperture 21 in fluid communication with the expansion opening 11, a second aperture 22 in fluid communication with the annulus 2 and a third aperture 23 in fluid communication with the expandable space 10. The valve unit 20 further comprises a unit bore 24 having a bore extension and comprising a first bore part 25 and a second bore part 26, the first aperture 21 being arranged in the first bore part 25, and the second aperture 22 and the third aperture 23 being arranged in the second bore part 26 and displaced along the bore extension. A unit piston 27 is arranged in the unit bore 24. The unit piston 27 comprises a first piston part 28 which is arranged in the second bore part 26 in the first position and has an outer diameter OD1 substantially corresponding to an inner diameter ID1 of the second bore part 26, and the unit piston 27 further comprises a second piston part 29 which is arranged in the first bore part 25 in the first position and has an outer diameter OD2. The first bore part 25 has an inner diameter ID2. A shear element 31 prevents movement of the unit piston 27 until a predetermined force is reached. In the first position of the valve unit 20, the second aperture 22 is in fluid communication with the third aperture 23 so that pressure equalisation occurs between the annular space and the annulus while running the annular barrier 1 into the well. The valve unit 20 further comprises a piston sleeve 32 arranged in the unit bore 24 having an edge 35 extending radially inwards in relation to the bore extension, the piston sleeve 32 at least partly circumferenting the second piston part 29, and the shear element 31 engages both the unit piston 27 and the piston sleeve 32 so that the unit piston 27 and the piston sleeve 32 are fastened together until the piston sleeve 32 is prevented by the edge from moving, and the shear element 31 is sheared.

The pressurised fluid led into the first aperture 21 presses on the piston sleeve 32, and the second piston part 29 breaks the shear element 31 when the predetermined force is reached as the piston sleeve 32 is prevented from moving with the second piston part 29, and the shear element 31 is sheared. By having the piston sleeve 32 arranged at least partly to surround the second piston part 29, and once the shearing has occurred, a small release of pressure will move the unit piston 27 to the second position as the pressure no longer acts on the piston sleeve 32, and the cement therefore cannot be sucked into the well tubular metal structure 3 as the pressure is not released completely in order to move the valve from a "run-in" position to an "expansion" position. Thus, the annular barrier 1 can be set without releasing the pressure completely, but merely a small decrease in pressure will move the valve unit 20 from the first position to the second position, i.e. the expansion position.

By having the shear pin engaging both the piston sleeve 32 and the second piston part 29, it is ensured that the unit piston 27 is not moved during the cement operation run at a lower pressure, but only when the completion process is ready for the expansion mode.

In FIG. 2, the annular barrier 1 further comprises a locking mechanism 33 configured to lock the unit piston 27 in the second position. The locking mechanism 33 in FIG. 2 comprises a spring-biased pin in an indentation and is configured to project into the bore once the unit piston 27 moves from the first position to the second position. By locking the unit piston 27 in the second position, the unit piston 27 does not unintentionally change position away from the expansion mode during an interruption in pressure during expansion of the expandable metal sleeve 8 and thus during setting of the annular barrier 1.

The first and second piston parts 28, 29 comprise sealing means 34 arranged in circumferential grooves on an outer face of the piston parts. The outer diameter of the second piston part 29 is at least somewhat larger than the outer diameter of the first piston part 28 so that it is ensured that the unit piston 27 moves towards the edge 35. The piston sleeve 32 also comprises sealing means 34 arranged in circumferential grooves in an outer face of the piston sleeve 32. An inner diameter ID3 of the piston sleeve 32 corresponds to the outer diameter OD2 of the second piston part 29. At least a first part 25*a* of the first bore part 25 has a larger inner diameter ID4 than the second bore part 26, and the piston sleeve 32 is arranged in the first part 25*a*, and the first part 25*a* of the first bore part 25 is arranged further away from the first piston part 28 than the first aperture 21. The inner diameter ID4 of the first part 25*a* corresponds to the outer diameter OD2 of the piston sleeve 32.

The unit bore 24 comprises a spring element 51 arranged between the second piston part 29 and a first end of the unit bore 24, the unit bore 24 comprising a second end arranged at the second bore part 26. As the unit piston 27 moves to shear the shear element 31 between the piston sleeve 32 and the second piston part 29, the spring element 51 is compressed, and once the pressure is partly released, the spring element 51 assists the unit piston 27 in moving to the second position. The unit piston 27 has an intermediate part 36 arranged between the first and second piston parts 28, 29, the intermediate part having a smaller outer diameter than that of the first and second piston parts 28, 29. The valve unit 20 has a venting channel 54B so that the unit piston 27 can move when the pressure is released.

In FIGS. 3 and 5, the piston sleeve 32 has a first sleeve part 32*b*, 52 and a second sleeve part 32*a*, 53. The first sleeve part 32*b*, 52 and the second sleeve part 32*a*, 53 are two separate parts, and the shear element 31 engages only the second sleeve part 32*a*, 53. The first sleeve part 32*b*, 52 abuts the second sleeve part 32*a*, 53, and the first sleeve part 32*b*, 52 is arranged closer to the first piston part 28 than the second sleeve part 32*a*, 53 along the bore extension. The second sleeve part 32*a*, 53 is in the form of several collets 58 which are held together around the second piston part 29 by fastening elements 54. The several collets 58 form the locking mechanism 33 instead of the locking mechanism shown in FIG. 2. The piston sleeve 32 has a first inner diameter ID3,1 (shown in FIG. 5) corresponding to the outer diameter of a first part of the second piston part 29 and a second inner diameter ID3,2 (shown in FIG. 5) corresponding to the outer diameter of a second part of the second piston part 29, which is smaller than the first part of the second piston part 29. The first part of the second piston part 29 comprises sealing means and is circumferented by the piston sleeve 32. The first part of the second piston part 29 is arranged closer to the first piston part 28 than the second part of the first piston part 28. The piston sleeve 32 has an even outer diameter, but two inner diameters so that the piston sleeve 32 has a thicker part in which the sealing means are arranged and a thinner part in which the piston sleeve 32 leaves room for the second piston part 29, which has a larger outer diameter on which the pressure can act. The unit piston 27 comprises a third piston part 61 arranged in a third bore part 53B, and the spring element 51 is arranged to abut the third piston part 61 and the first end. The unit bore 24 has an edge 35 extending between the inner diameter ID4 of the first part 25*a* of the first bore part 28 and radially inwards in relation to the bore extension. In FIG. 3, the edge 35 is provided by an end of a sleeve element 39 in the first bore part 25, and in FIG. 8 the edge is provided by a decreased inner diameter of the bore part, i.e. by the wall or body forming the bore 24. The sleeve element 39 has an outer diameter corresponding to the inner diameter of the first part of the first bore part 25 and has an inner diameter corresponding to an outer diameter of a second part of the first piston part 28. The outer diameter of the first part of the second piston part 29 is larger than the outer diameter of the second part of the second piston part 29.

In FIGS. 3 and 5, the unit piston 27 comprises a fluid channel 45 that is a through-bore providing fluid communication between the first bore part 25 and the second part of the second bore part 26. The piston sleeve 32 has a first end surface 49, and the first piston part 28 has a first piston face 47 facing the first aperture 21. The second piston part 29 has a second piston face 48 facing the first aperture 21, and the first end face and the second piston face 48 have a common face area being larger than the first piston face 47. The pressurised fluid entering the first aperture 21 presses onto both the common face and the first piston face 47, and as the common face area is larger than the first piston face 47, the unit piston 27 moves to the right in FIGS. 3 and 5, compressing the spring element 51. When the piston sleeve 32 contacts the edge, the piston sleeve 32 is prevented from moving further to the right, thus shearing the shear element 31, and the unit piston 27 is then released to move further to the right until the pressure in the well tubular metal structure 3 is released, e.g. at 69-103 Bar (1,000-1,500 PSI), and this decrease in pressure enables the spring element 51 to move the unit piston 27 to the second position.

In FIG. 5, the valve unit 20 is in the same valve system 80 as a shear pin assembly 77. The shear pin assembly 77 has a first opening 16 in fluid communication with the second aperture 22 of the valve unit 20 so that when the unit piston 27 has changed position from the initial first position to the end and second position, the first opening 16 is in fluid communication with the inside of the tubular metal part 7. The shear pin assembly 77 further comprises a second opening 17 in fluid communication with the annular space of the annular barrier 1 and a third opening 37 in fluid communication with the annulus 2, i.e. one of a first zone 101 and a second zone 102 (shown in FIG. 7), or an anti-collapsing unit 111 shown in FIG. 6. An assembly piston 41 has the first position in which the first opening 16 is in fluid communication with the second opening 17 and the second position in which the second opening 17 is in fluid communication with the third opening 37 in order to equalise the pressure between the annular space and the annulus 2. In the first position, expansion fluid from the second aperture 22 of the valve unit 20 is allowed to flow into the annular space through the first opening 16, and in the second position fluid connection to the second aperture 22 is blocked, preventing expansion fluid from entering the space after expansion. The annular barrier 1 is thereby permanently isolated from the well tubular metal structure 3 after expansion so that a later malfunction of the annular barrier 1 does not interfere with the inside of the well tubular metal structure 3 and thus the production fluid flowing therein. The shear pin assembly 77 has a bore 18 having a bore extension and comprising a first bore part 19 and a second bore part 40. The first bore part 19 has a first inner diameter, and the second bore part 40 has an inner diameter which is larger than that of the first bore part 19. The first opening 16 and the second opening 17 are arranged in the first bore part 19 and displaced along the bore extension. The shear pin assembly 77 further comprises the assembly piston 41 arranged in the bore 18. The assembly piston 41 comprises a first piston part 42 having an outer diameter substantially corresponding to the inner diameter of the first bore part 19 and further comprises a second piston part 43 having an outer diameter substantially corresponding to the inner diameter of the second bore part 26. The shear pin assembly 77 further comprises a rupture element 44 preventing movement of the assembly piston 41 until a predetermined pressure in the bore is reached as then the rupture element is broken and no longer prevents the assembly piston 41 from moving. The shear pin assembly 77 further comprises a locking element 38 adapted to mechanically lock the assembly piston 41 when the assembly piston 41 is in the closed position, blocking the first opening 16.

In FIG. 4, the downhole annular barrier 1 further comprises the anti-collapsing unit 111 comprising an element 201 (shown in FIG. 6) movable between a first unit position (moving to an end 36A in FIG. 6) and a second unit position (moving to an end 36B in FIG. 6), compressing compliant material 29B (shown in FIG. 6). The anti-collapsing unit 111 has a first inlet 25B which is in fluid communication with the first zone 101 (shown in FIG. 7) and a second inlet 26B which is in fluid communication with the second zone 102 (shown in FIG. 7). The anti-collapsing unit 111 furthermore has an outlet 27B which is in fluid communication with the annular space through the shear pin assembly 77 when the assembly piston 41 is in the closed second position, blocking the first opening 16. The first inlet 25B is in fluid communication with the outlet 27B for equalising the first pressure $P_1$ (shown in FIG. 1) of the first zone 101 with the annular space in the first unit position, and in the second unit position the second inlet 26B is in fluid communication with the outlet for equalising the second pressure $P_2$ (shown in FIG. 1) of the second zone 102 with the space pressure.

As shown in FIG. 4, the shear pin assembly 77 has a port A receiving fluid from an inside of the well tubular metal structure 3 through the valve unit 20 after the unit piston 27 has changed position from the initial position to the end position. The valve unit 20 may be fluidly connected to the inside via a screen 44B. The port A is fluidly connected with a port D during expansion (in the first position of the shear pin assembly 77), causing the expansion fluid within the well tubular metal structure 3 to expand the expandable metal sleeve 8. When the expandable metal sleeve 8 is expanded to abut the wall of the well tubular metal structure 3, the pressure builds up, and a shear pin or disc within the shear pin assembly 77 shears, thus closing the fluid connection from port A and opening 17 (as shown in FIG. 5B) and opening the fluid connection between a port B (in fluid communication with the outlet 27B) and a port C (in fluid communication with the space 10) so that fluid from the second inlet 26B can be led into the expandable space 10 through the shear pin assembly 77 and through port D. When the first pressure increases in the first zone 101, fluid from a port E connected with a port I, being the first inlet 25B, presses the element 201 (shown in FIG. 6) to move so that fluid communication is provided between port I and a port H, being the outlet 27B, and thus further through ports B and C and into the expandable space 10 through port D. When the second pressure increases in the second zone 102, the element 201 is forced in the opposite direction, and fluid communication between port G (in fluid communication with the second zone 102 through port F) and port H is provided, i.e. fluid communication between the second inlet 26B and the outlet 27B of the anti-collapsing unit 111, and thus fluid is led into the annular space through ports B, C and D.

FIG. 7 shows a cross-sectional view of a downhole system 100 comprising a well tubular metal structure 3 and several annular barriers 1 which have been expanded in the annulus 2 between the well tubular metal structure 3 and an inside face of the borehole 4. Each annular barrier 1 provides zone isolation between the first zone 101 and the second zone 102 of the borehole 4. The annular barrier 1 has a longitudinal extension which coincides with the longitudinal extension of the casing/well tubular metal structure 3. The annular barrier 1 comprises the tubular metal part 7, which may be a separate tubular metal part or a casing part for mounting a part of the well tubular metal structure 3. Furthermore, the annular barrier 1 comprises the expandable metal sleeve 8, which surrounds the tubular metal part 7, and each end 9 of the expandable metal sleeve 8 may be connected with the tubular metal part 7 by means of connection parts. The expandable metal sleeve 8 and the tubular metal part 7 enclose an expandable space 10, and as shown in FIG. 1 the expansion opening 11 is provided in the tubular metal part 7, through which fluid may enter the expandable space 10 via at least the valve unit 20 in order to expand the expandable metal sleeve 8.

In FIG. 8, the bore 24 comprises the first bore part 25, the second bore part 26 and the third bore part 53B, and the first bore part 25 is arranged between the second bore part 26 and the third bore part 53B. The first bore part has a first inner diameter ID1,3, the second bore part 26 has a second inner diameter ID2,3, and the third bore part 53B has a third inner diameter ID3,3, the third inner diameter being smaller than the first inner diameter forming the edge 35. Thus, the edge is formed by the body in which the unit bore 24 is arranged, i.e. formed by the wall surrounding the unit bore. Thus, the unit bore 24 may have an edge, forming the edge 35, extending between an outer inner diameter of the first part of the first bore part 25 and radially inwards in relation to the bore extension.

As shown in FIG. 1, the expandable metal sleeve 8 comprises sealing elements 116 on the outer face 14 and projections 133 to abut the inner face of the borehole 4 so that fluid is prevented from flowing freely from the first zone 101 to the second zone 102, as shown in FIG. 7. The sealing elements 116 may comprise a split-ring-shaped element 117 having several windings 118, providing back-up for the sealing element 116 during expansion as it unwinds.

As shown in FIG. 7, two annular barriers 1 are often used to isolate a production zone 400. A fracturing valve or an inflow valve section 120, also called a frac port or inflow/production valve, is arranged in between the annular barriers 1 so that when the annular barriers 1 have been expanded, the frac port or valve 120 is opened, and fluid is led into the formation for creating fractures in the formation to ease the flow of hydrocarbon-containing fluid, such as oil, into the well tubular metal structure 3. The fracturing valve or inflow valve section 120 may also comprise an inlet section, which may be the same as the frac port. A screen may be arranged so that the fluid is filtered before flowing into the casing.

By "fluid" or "well fluid" is meant any kind of fluid that may be present in oil or gas wells downhole, such as natural gas, oil, oil mud, crude oil, water, etc. By "gas" is meant any kind of gas composition present in a well, completion or open hole, and by "oil" is meant any kind of oil composition, such as crude oil, an oil-containing fluid, etc. Gas, oil and water fluids may thus all comprise other elements or substances than gas, oil and/or water, respectively.

By "annular barrier" is meant an annular barrier comprising a tubular metal part mounted as part of the well tubular metal structure and an expandable metal sleeve surrounding and connected to the tubular metal part defining an annular barrier space.

By "casing" or "well tubular metal structure" is meant any kind of pipe, tubing, tubular, liner, string, etc., used downhole in relation to oil or natural gas production.

In the event that the tool is not submergible all the way into the casing, a downhole tractor can be used to push the tool all the way into position in the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor.

Although the invention has been described above in connection with preferred embodiments of the invention, it will be evident to a person skilled in the art that several modifications are conceivable without departing from the invention as defined by the following claims.

The invention claimed is:

1. An annular barrier for providing zonal isolation in an annulus downhole between a well tubular metal structure and another well tubular metal structure or a wall of a borehole, comprising:

a tubular metal part configured to be mounted as part of the well tubular metal structure and having an inside and an axial extension along the well tubular metal structure, an expandable metal sleeve surrounding the tubular metal part, each end of the expandable metal sleeve being connected with the tubular metal part, defining an expandable space between the expandable metal sleeve and the tubular metal part, and an expansion opening in the tubular metal part through which fluid enters in order to expand the expandable metal sleeve, wherein the annular barrier further comprises a valve unit having a first position and a second position; the valve unit being configured to, in the second position, lead pressurised fluid from the expansion opening to the expandable space for expanding the expandable metal sleeve, the valve unit comprises a first aperture in fluid communication with the expansion opening, a second aperture in fluid communication with the annulus and a third aperture in fluid communication with the expandable space, the valve unit further comprising:

a unit bore having a bore extension and comprising a first bore part and a second bore part, the first aperture being arranged in the first bore part, and the second aperture and the third aperture being arranged in the second bore part and displaced along the bore extension, a unit piston arranged in the unit bore, the unit piston comprising a first piston part which is arranged in the second bore part in the first position and has an outer diameter substantially corresponding to an inner diameter of the second bore part, and the unit piston further comprising a second piston part which is arranged in the first bore part in the first position and has an outer diameter, a shear element preventing movement of the unit piston from the first position to the second position until a predetermined force is reached, and a locking mechanism configured to lock the unit piston in the second position, wherein the second aperture is in fluid communication with the third aperture in the first position so that pressure equalisation between the annular space and the annulus occurs while running the annular barrier into the well, and wherein the valve unit further comprises a piston sleeve arranged in the unit bore, said unit bore having an edge extending radially inwards in relation to the bore extension, the piston sleeve at least partly circumferenting the second piston part, and the shear element engages both the unit piston and the piston sleeve so that the unit piston and the piston sleeve are fastened together until the piston sleeve is prevented from moving by the edge, and the shear element is sheared.

2. An annular barrier according to claim 1, wherein the outer diameter of the second piston part is larger than the outer diameter of the first piston part.

3. An annular barrier according to claim 1, wherein the piston sleeve comprises sealing means arranged in circumferential grooves in an outer face of the piston sleeve.

4. An annular barrier according to claim 1, wherein an inner diameter of the piston sleeve corresponds to the outer diameter of the second piston part.

5. An annular barrier according to claim 1, wherein at least a first part of the first bore part has a larger inner diameter than the second bore part.

6. An annular barrier according to claim 5, wherein the first part of the first bore part has an inner diameter corresponding to the outer diameter of the piston sleeve.

7. An annular barrier according to claim 1, wherein the unit bore comprises a spring element arranged between the second piston part and a first end of the unit bore, the unit bore comprising a second end arranged at the second bore part.

8. An annular barrier according to claim 1, further comprising a shear pin assembly configured to permanently isolate the annular barrier from the well tubular metal structure after expansion, said shear pin assembly having a first opening in fluid communication with the second aperture of the valve unit, a second opening in fluid communication with the annular space of the annular barrier and a third opening in fluid communication with the annulus, the shear pin assembly having a first position in which expansion fluid from the second aperture of the valve unit is allowed to flow into the annular space and a second position in which fluid connection to the second aperture is blocked, which prevents expansion fluid from entering the space.

9. A downhole annular barrier according to claim 1, further comprising an anti-collapsing unit comprising an element movable between a first unit position and a second unit position, the anti-collapsing unit having a first inlet which is in fluid communication with the first zone and a second inlet which is in fluid communication with the second zone, and the anti-collapsing unit having an outlet which is in fluid communication with the annular space through the shear pin assembly when the assembly piston is in the closed position, blocking the first opening.

10. Downhole system comprising the annular barrier according to claim 1 and the well tubular metal structure.

* * * * *